US007481177B2

(12) United States Patent
Hearne

(10) Patent No.: US 7,481,177 B2
(45) Date of Patent: Jan. 27, 2009

(54) AIR SCOOP DEVICE

(76) Inventor: Bruce Hearne, 846 Wilma Ave., Radcliff, KY (US) 40160

( * ) Notice: Subject to any disclaimer, the term of this patent is extended or adjusted under 35 U.S.C. 154(b) by 0 days.

(21) Appl. No.: 11/487,762

(22) Filed: Jul. 17, 2006

(65) Prior Publication Data

US 2008/0035048 A1 Feb. 14, 2008

(51) Int. Cl.
*B63B 17/00* (2006.01)
*B60J 1/02* (2006.01)

(52) U.S. Cl. ..... 114/361; 296/96.11; 296/180.1

(58) Field of Classification Search ..... None
See application file for complete search history.

(56) References Cited

U.S. PATENT DOCUMENTS 1,969,934 A * 8/1934 Lintern et al. ..... 454/138
3,018,784 A * 1/1962 Buxman ..... 114/361
3,656,423 A * 4/1972 Anthony ..... 454/136
5,709,163 A * 1/1998 Livingston ..... 114/211
6,164,714 A * 12/2000 Gleason et al. ..... 296/107.1
6,253,702 B1 * 7/2001 Schoeller, Jr. ..... 114/361

* cited by examiner

*Primary Examiner*—Jesus D Sotelo
(74) *Attorney, Agent, or Firm*—Justin R Wall

(57) ABSTRACT

Disclosed is an air scoop device for installation on a windshield header member of an open top vehicle, for example, convertible cars, water boats, water crafts and the like. The air scoop device has a scoop body configuring a hollow interior space capable of receiving air through a first area into the hollow interior space and directing the air out of the hollow interior space through a second area towards a foot-well area of the open top vehicle.

18 Claims, 4 Drawing Sheets

AIR SCOOP DEVICE

FIELD OF THE INVENTION

The present invention relates to an air scoop device for cooling foot-well area of open top vehicles, for example, convertible cars, water boats, water crafts, and the like, in driving state.

BACKGROUND OF THE INVENTION

Generally open top vehicles or watercraft driving over long and short distances are not comfortable due to ineffective methods of directing ventilation to the lower body and foot-well areas, thereby cooling the same. While conventional ventilation devices including air conditioning are suited for their intended usage, none of these devices utilize means that are sized and designed to allow a sufficient airflow at higher speeds to the foot-well area to keep the driver and passengers cool below the waist.

Accordingly, there remains a need for a device that effectively receives and directs sufficient air to the foot-well area of an open top vehicle in a non-obtrusive, easy, and cost effective manner.

SUMMARY OF THE INVENTION

In view of the foregoing disadvantages inherent in the prior arts, the general purpose of the present invention is to provide a hand tool configured to include all the advantages of the prior art, and to overcome the drawbacks inherent therein.

In one aspect, the present invention provides an air scoop device for installation on a windshield header member of an open top vehicle. The air scoop device has a scoop body that configures a hollow interior space capable of receiving air through a first area into the hollow interior space and directs the air out of the hollow interior space through a second area towards a foot-well area of the open top vehicle.

In another aspect, the present invention provides an air scoop device. The air scoop device comprising a scoop body having a curved wall extending from a front edge to a bottom edge, a first sidewall extending from a first side of the curved wall, the first sidewall having a first leading edge and a cutout extending from the first leading edge towards the first side of the curved wall, and a second sidewall extending from a second side of the curved wall, the second sidewall having a second leading edge and a cutout extending from the second leading edge towards the second side of the curved wall, the curved wall, the first sidewall, and the second sidewall configures a hollow interior space therein; and a retention system removably engaged to the scoop body. The air scoop device is capable of being installed on a windshield header member of an open top vehicle to configure a first area between the front edge and a top portion of the windshield header member and a second area between the bottom edge and the first leading edge and the second leading edge in a manner, such that, air entering the hollow interior space through the first area is directed out of the hollow interior space through the second area towards foot-well area of the open top vehicle.

In yet another aspect, the present invention provides an air scoop device for directing air to a foot-well area of a car. The air scoop device comprises a scoop body and a retention system. The scoop body has a curved wall extending from a front edge to a bottom edge; a first sidewall extending from a first side of the curved wall, the first sidewall having a first leading edge and a cutout extending from the first leading edge towards the first side of the curved wall; a second sidewall extending from a second side of the curved wall, the second sidewall having a second leading edge and a cutout extending from the second leading edge towards the second side of the curved wall, the curved wall, the first sidewall, and the second sidewall configures a hollow interior space therein; and protruding members extending from the first side wall and the second side wall towards the hollow interior space. The retention system has a retention rod, and at least one pole extending vertically from the retention rod, the pole capable of being engageably received within a protruding cup disposed on an inner surface of a top portion of the scoop body. The retention rod and a portion of the pole is capable of being engageably received within a groove on an upper portion of the windshield header member of a car and the lower portion of the windshield header member is received on the protruding members, thereby installing the air scoop device on the windshield header member. In the installed state, a first area is configured between the front edge and a top portion of the windshield header member and a second area is configured between the bottom edge and the first leading edge and the second leading edge in a manner, such that, air entering the hollow interior space through the first area is directed out of the hollow interior space through the second area towards the foot-well area of the car.

These together with other aspects of the present invention, along with the various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there are illustrated exemplary embodiments of the present invention.

BRIEF DESCRIPTION OF THE DRAWINGS

The advantages and features of the present invention will become better understood with reference to the following more detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular air scoop device, as shown and described. It is understood that various omissions, substitutions of equivalents are contemplated as circumstances may suggest or render expedient, but is intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides an air scoop device that cools the foot-well area of open top vehicles, for example, convertible cars, water boats, water crafts, and the like, during driving. As used herein, a 'foot-well area' generally refers to an area of a car that accommodates lower waist region of a person sitting on front seat of the car. For a convertible car, the air scoop device is designed as per automotive standards and is capable of being installed on a windshield header member of the convertible car. The air scoop device allows sufficient quantity of fresh air to be directed to the foot-well area. The circulation of fresh air in the foot-well area helps in cooling the lower waist region of the person sitting on the front seat. The air scoop device may be mass manufactured in a simple and cost effective manner. Although, the air scoop device of the present invention is ideally suited for use with convertible cars, the air scoop device may be designed to be installed on non-convertible cars and other open top vehicles, water boats and water crafts.

Figure 1:
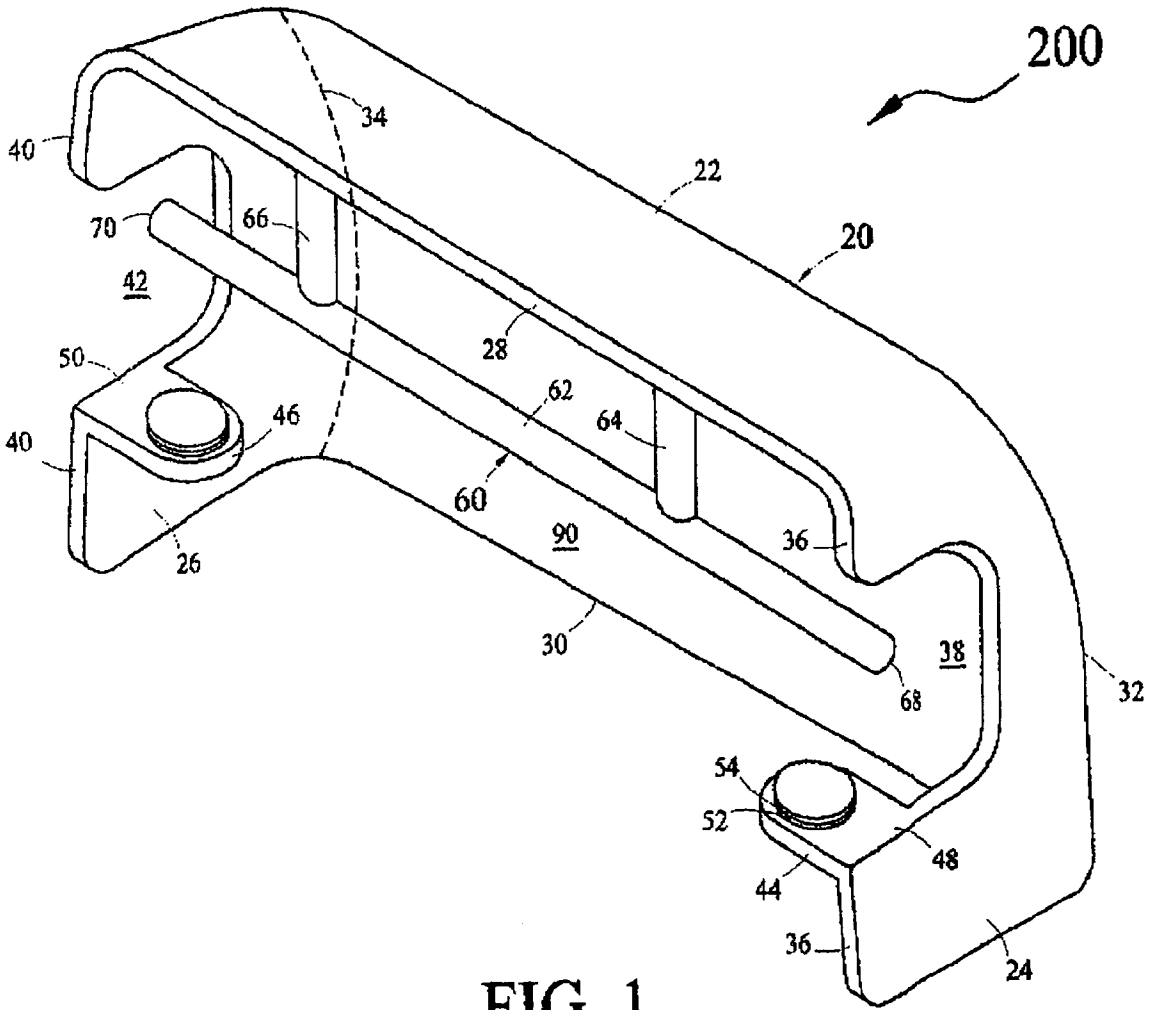
FIG. 1 is a perspective view of an air scoop device 200, according to an exemplary embodiment of the present invention.
Figure 2:
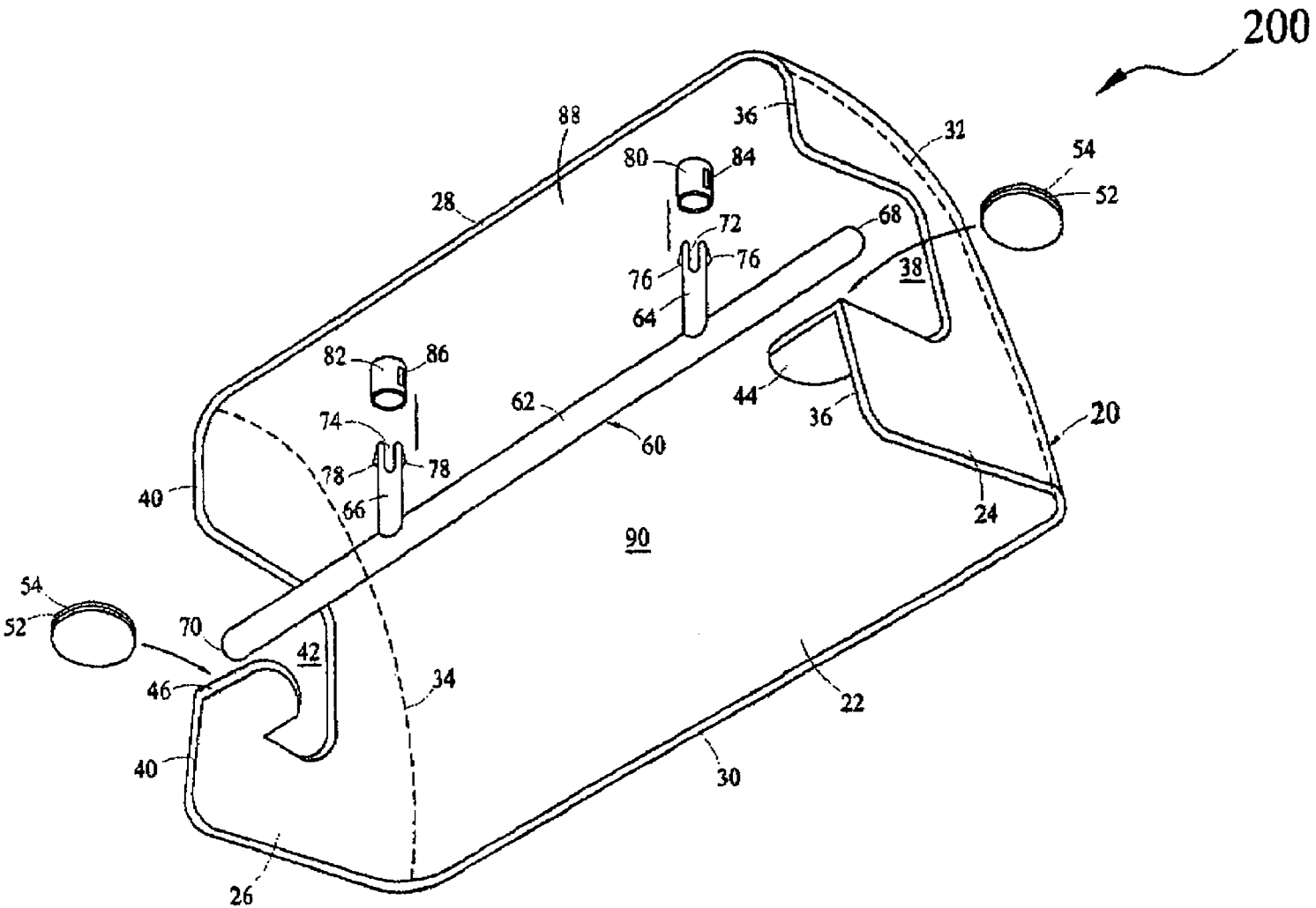
FIG. 2 is an exploded view of the air scoop device 200, according to an exemplary embodiment of the present invention.

Referring to FIGS. 1 and 2, an air scoop device 200, is shown. The air scoop device 200 comprises a scoop body 20 and a retention system 60 removably engaged to the scoop body 20. The scoop body 20 has a curved wall 22, a first sidewall 24 and a second sidewall 26. The curved wall 22 has a front edge 28, a bottom edge 30, a first side 32 and a second side 34. The curved wall 22 extends from the front edge 28 to the bottom edge 30. The first side wall 24 and the second side wall 26 extend from the first side 32 and the second side 34 of the scoop body 20, respectively, such that, the curved wall 22, the first sidewall 24 and the second sidewall 26 configure a hollow interior space 90 therein. The first sidewall 24 has a first leading edge 36 and a cutout 38 extending from the first leading edge 36 towards the first side 32 of the scoop body 20. Similarly, the second sidewall 26 has a second leading edge 40 and a cutout 42 extending from the second leading edge 40 towards the second side 34 of the scoop body 20. Protruding members 44, 46 extend from the first sidewall 24 and the second sidewall 26, respectively, towards the hollow interior space 90. More specifically, the protruding members 44, 46 extend from lower edges 48, 50 of the cutouts 38, 42, respectively.

The retention system 60 has a retention rod 62 and at least one pole extending vertically from the retention rod 62. In an embodiment, the retention system 60 has two poles 64, 66 extending vertically from the retention rod 62. The retention rod 62 has an elongated cylindrical geometry with a first end 68 and a second end 70. The poles 64, 66 are positioned at equal distance from the first end 68 and the second end 70 in a manner, such that, the poles 64, 66 are engageably received within protruding cups 80, 82 disposed on an inner surface 88 of a top portion of the scoop body 20. For such an engagement, the poles 64, 66 have an engagement profile (e.g., threaded bolts, screws, insert posts, hinges and the like) that removably engage with a complementary engagement profile (e.g., threaded sleeves, grooves, insert holes, and the like) of the protruding cups 80, 82. As shown in FIG. 2, in one embodiment, the poles 64, 66 have a cutout section 72, 74 with two sideways protruding locking edges 76, 78, while the protruding cups 80, 82 are in the form of groove-like structures with two cutouts 84, 86 on opposite sides. The poles 64, 66 may be pressed on the sides and introduced into the protruding cups 80, 82 to be engageably received within the protruding cups 80, 82 with the locking edges 76, 78 locking into cutouts 84, 86. For disengaging the retention system 60, the poles 64, 66 may be pressed on the sides to unlock the locking edges 76, 78 out of the cut outs 84, 86, thereby releasing the poles 64, 66 out of the protruding cups 80, 82.

Figure 3:
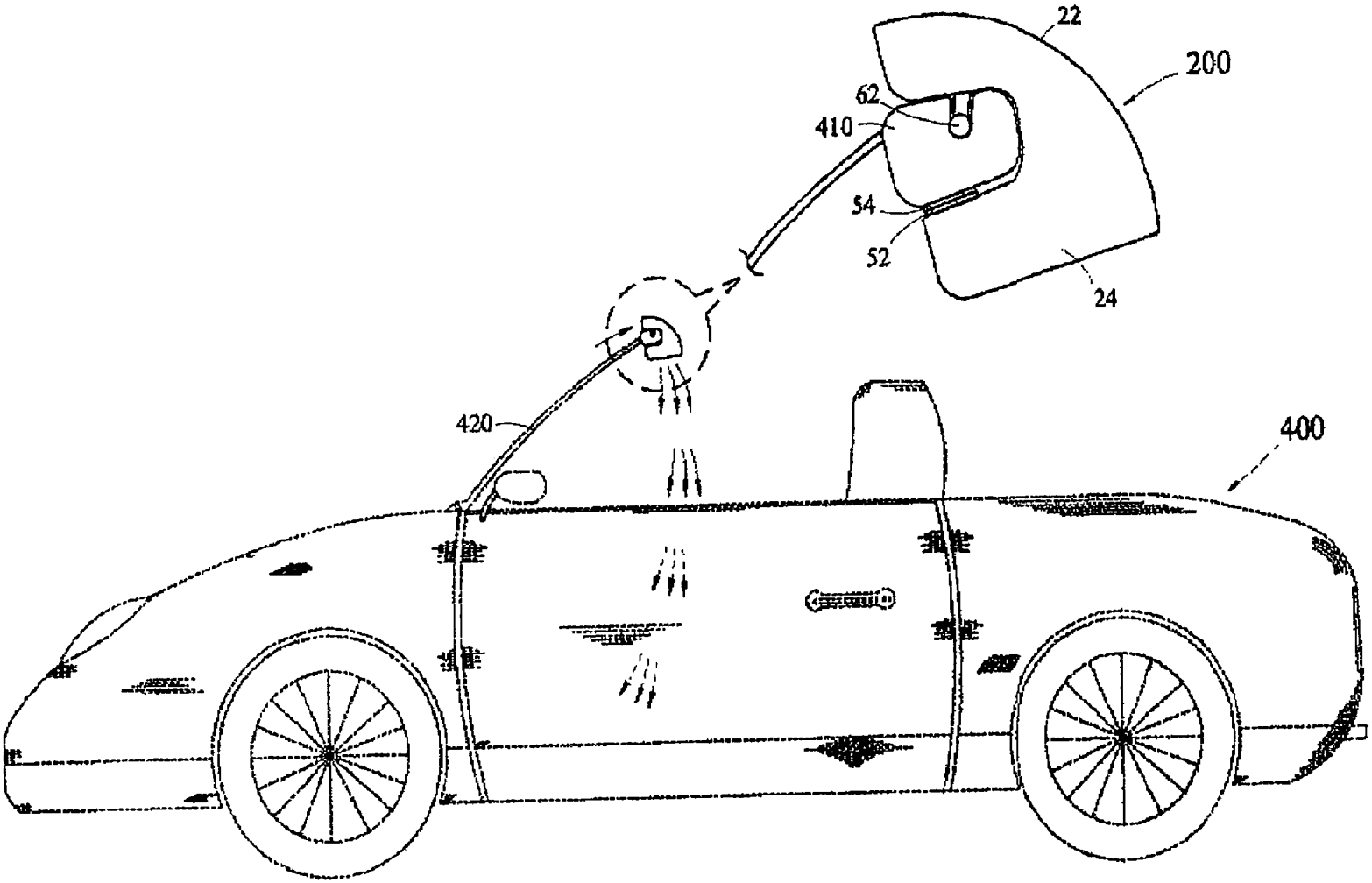
FIG. 3 is a perspective view of a convertible car 400 with the air scoop device 200 installed on a windshield header member 410, according to an exemplary embodiment of the present invention.
Figure 4:
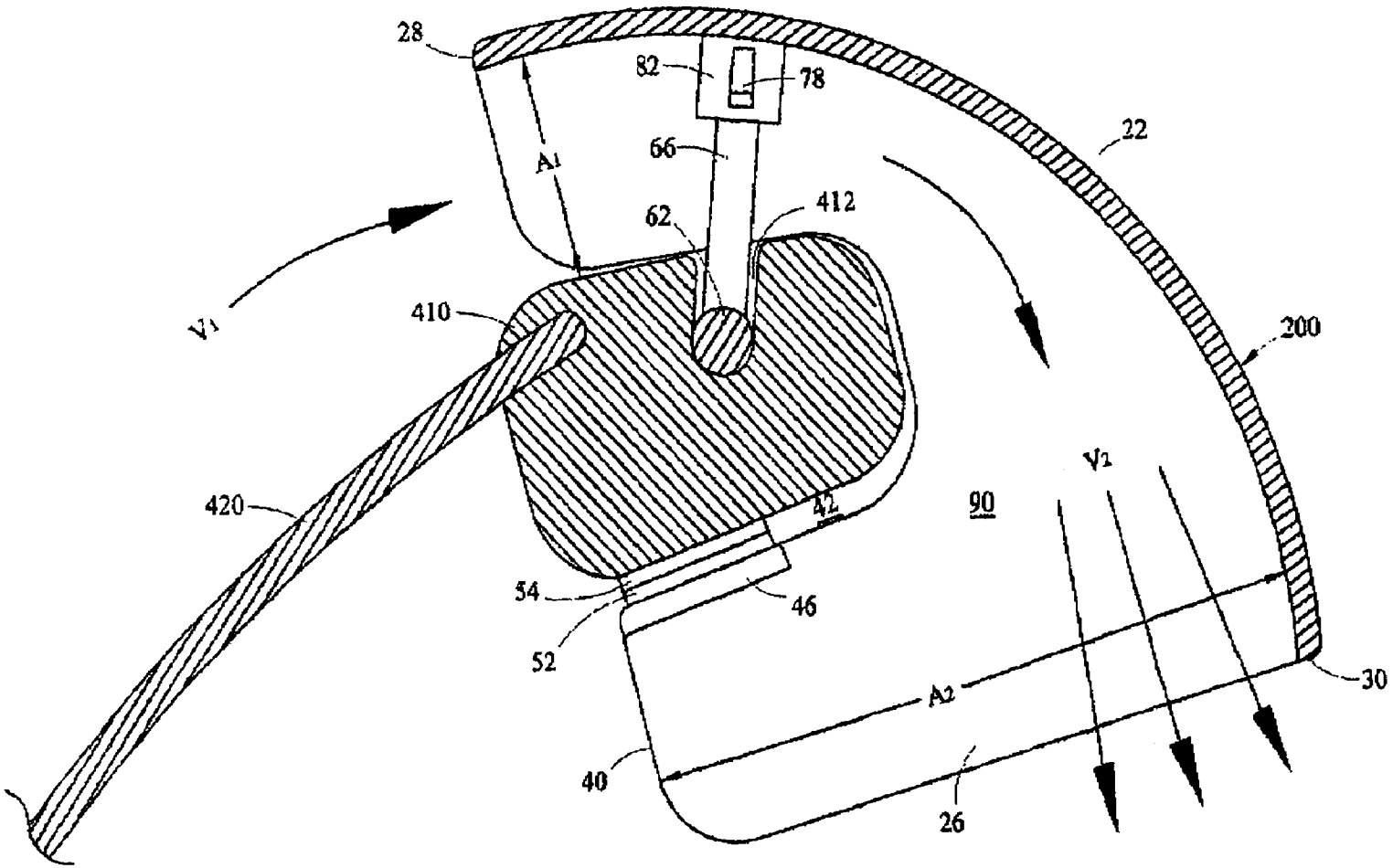
FIG. 4 is a sectional view of the air scoop device 200 in the installed condition, as shown in FIG. 3, according to an exemplary embodiment of the present invention.

Referring to FIGS. 3 and 4, illustrated is a convertible car 400 (hereinafter referred to as car 400) with the air scoop device 400 installed therein. The air scoop device 200 may be installed in a manner, such that, the air scoop device is removably engaged to a windshield header member 410 of the car 400. As used herein, the windshield header member 410 is a member that is generally disposed at top portion of a windshield 420 of the car 400. The windshield header member 410 is generally provided in a car. Alternatively, the windshield header member 410 may be supplied in a combination with the air scoop device 200. The windshield header member 410 may have a groove 412 running across a length of the windshield header member 410. The groove 412 has a geometry that sufficiently engages the retention system 60 of the air scoop device 200. More specifically, the retention rod 62 and at least a portion of the poles 64, 66 is received within the groove 412. In the installed position, a portion of the windshield header member 410 equal to a distance between the first sidewall 24 and the second sidewall 26 is enclosed within the interior space 90 bounded by the cutouts 38, 42. Also, in this installed position, a lower portion of the windshield header member 410 may rest on the protruding members 44, 46.

To further strengthen the engagement between the windshield header member 410 and the air scoop device 200, the protruding members 44, 46 may have features for bonding the protruding members 44, 46 to the lower portion of the windshield header member 410. For example, the protruding members 44, 46 have a dual lock pad 52 (for example, a Velcro strip) or any similar fastening means that bond with a complementary dual lock pad 54 (for example, a complementary Velcro strip) disposed on the lower portion of the windshield header member 410. The disposal of dual lock pad 52 on the protruding members 44, 46 and of the complementary dual lock pad 54 on the lower portion of the windshield header member 410 may be carried out in various fashions, such as thermal bonding (e.g., pattern bonded), ultrasonic bonding, adhesive bonding (e.g., adhesive, resin, latex, and the like), and/or mechanical bonding (e.g., through-air dried attachment, and the like).

The installation of the air scoop device 100 on the windshield header member 410 may be carried out in a quick and easy manner. Firstly, the retention system 60 of the air scoop device 200 may be introduced into the groove 412 of the windshield header member 410, such that, the retention rod 62 and a portion of the poles 64, 66 may be engageably received within the groove 412. Next, the dual lock pad 52 is disposed on protruding members 44, 46; and the complementary dual lock pad 54 is disposed on the lower portion of the windshield header member 410. Finally, the scoop body 20 of the air scoop device 200 is introduced to enclose a portion of the windshield header member 410 equal to the distance between the first sidewall 24 and the second sidewall 26, while allowing the poles 64, 66 to be received within the protruding cups 80, 82, and simultaneously further strengthening the bonding between the windshield header member 410 and the air scoop device 200 due to the bonding between the dual lock pad 52 and the complementary dual lock pad 54.

In the driving state, air strikes the windshield 420 of the car 400 and enters into the hollow interior space 90 through a first area $A_1$ (See FIG. 4) between the front edge 28 and a top portion of the windshield header member 410. Next, the air strikes the curved wall 22, the first side wall 24 and the second side wall 26, and gets directed out of the hollow interior space 90 through a second area $A_2$ between the bottom edge 30 and the first and second leading edges 36, 40 in a manner, such that, air reaches the foot-well area of the car due to the high velocity of the air and directed by scoop like structure (See FIG. 3). Preferably, the second area $A_2$ is greater than the first area $A_1$, such that, the air entering at a higher velocity $V_1$ through the first area A1 is directed out at a lower velocity $V_2$ through the larger second area $A_2$ to cool the lower waist region of the person sitting on the front seat without providing unnecessary air flow to the foot-well area of the car.

The air scoop device 200 may be made of any material providing sufficient structural integrity to enable the air scoop device 200 to be suitably installed on the windshield header member 410 and for maintaining the orientation for the proper direction of air to the foot-well area, while also providing aesthetic appearance. Suitable materials include, but are not limited to, thermoformed plastics, such as, polyolefines, polyesters, polybutylene terephthalate, acrylonitrile butadiene styrene (ABS), and the like. Optionally, the scoop body 20 and the retention system 60 (i.e., the retention rod 62 and the poles 64, 66) may be made of different materials. Various processes may be employed to form the air scoop device 200 and the scoop cover 300. Suitable processes include, but are not limited to, injection molding, extrusion molding, blow molding, vacuum forming, compression molding, and the like.

The air scoop device 200 may have a color and texture that matches with the color and texture of bumper of car 400. Alternatively, the air scoop device may have any color and texture providing an aesthetic appearance. In one embodiment, the air scoop device 200 is non-reflective black with a sand textured finish. Additionally, aesthetic decorations and/or designs, product, manufacturer, and/or source identifiers, and the like may be disposed on one or more surfaces of the scoop body 20 of the air scoop device 200.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

What is claimed is:

1. An air scoop device, comprising:

a scoop body having a curved wall extending from a front edge to a bottom edge, a first sidewall extending from a first side of the curved wall, the first sidewall having a first leading edge and a cutout extending from the first leading edge towards the first side of the curved wall and a first protruding member extending from the first sidewall inwardly, and a second sidewall extending from a second side of the curved wall, the second sidewall having a second leading edge and a cutout extending from the second leading edge towards the second side of the curved wall and a second protruding member extending form the second sidewall inwardly, the first sidewall and the second sidewall configuring a hollow interior space therein;

a retention system removably engaged to the scoop body, wherein the retention system comprises a retention rod, and at least one pole extending vertically from the retention rod, the pole capable of being engageably received within a protruding cup disposed on an inner surface of a top portion of the scoop body.

2. The air scoop device of claim 1, wherein the air scoop device is capable of being installed on a windshield header member of an open top vehicle to configure a first area between the front edge and a top portion of the windshield header member and a second area between the bottom edge and the first leading edge and the second leading edge in a manner, such that, air entering the hollow interior space through the first area is directed out of the hollow interior space through the second area towards a foot-well area of the open top vehicle.

3. The air scoop device of claim 2, wherein in the installed state the retention rod and a portion of the pole are engageably received within a groove on an upper portion of the windshield header member.

4. The air scoop device of claim 2, wherein the protruding members further extend inwardly towards the hollow interior space, the protruding members capable of receiving a lower portion of the windshield header members.

5. The air scoop device of claim 2, wherein the protruding members have fastening means that bond with complementary fastening means on the lower portion of the windshield header member.

6. The air scoop device of claim 5, wherein the protruding members have a dual lock pad bonding with a complementary dual lock pad on the lower portion of the windshield header member.

7. The air scoop device of claim 2, wherein in the installed state a portion of the windshield header members equal to a distance between the first sidewall and the second sidewall is enclosed within the hollow interior space bounded by the cutouts of the first sidewall and the second sidewall. This side enclosure is designed to have all the air directed through the air scoop device to the wheel-wells.

8. The air scoop device of claim 1, wherein the pole has an engagement profile that removably engages with a complementary engagement profile of the protruding cup.

9. The air scoop device of claim 1, wherein the retention system has two poles extending vertically from the retention rod, the two poles capable of being engageable received within two protruding cups disposed on an inner surface of a top portion of the scoop body.

10. The air scoop device of claim 1, wherein the air scoop device is made of a thermoformed plastic selected from the group consisting of polyolefines, polyesters, polybutylene terephthalate, acrylonitrile butadiene styrene and combinations comprising at least one of the foregoing.

11. The air scoop device of claim 1, wherein the air scoop device is installed on an open top vehicle selected from the group consisting of convertible cars, water boats and water crafts.

12. An air scoop device for directing air to a foot-well area of a car comprising: a scoop body having a curved wall extending from a front edge to a bottom edge, a first sidewall extending from a first side of the curved wall. The first sidewall having a first leading edge and a cutout extending from the first leading edge towards the first side of the curved wall, a second sidewall extending from a second side of the curved wall, the second sidewall having a second leading edge and a cutout extending from the second leading edge towards the second side of the curved wall. The curved wall, the first sidewall, and the second sidewall configuring a hollow interior space therein, and protruding members extending from the first sidewall and the second side wall towards the hollow interior space, and a retention system having a retention rod, and at least one pole extending vertically from the retention rod, the pole capable of being engageably received within a protruding cup disposed on an inner surface of a top portion of the scoop body wherein the retention rod and a portion of the pole is capable of being engageably received within a groove on an upper portion of the windshield header member of a car and the lower portion of the windshield header member received on the protruding members thereby installing the air scoop device on the windshield header member, wherein in the installed state a first area is configured between the front edge and a top portion of the windshield header member and a second area is configured between the bottom edge and the first leading edge and the second leading edge in a manner, such that, air entering the hollow interior space through the first area is directed out of the hollow interior space through the second area towards the foot-well area of the car.

13. The air scoop device of claim 12, wherein the pole has an engagement profile that removably engages with a complementary engagement profile of the protruding cup.

14. The air scoop device of claim 12, wherein the retention system has two poles extending vertically from the retention rod, the two poles capable of being engageably received within two protruding cups disposed on an inner surface of a top portion of the scoop body.

15. The air scoop device of claim 12, wherein the protruding members have fastening features that bond with complementary fastening features on the lower portion of the windshield header member.

16. The air scoop device of claim 15, wherein the protruding members have a aaadual lock pad bonding with a complementary dual lock pad on the lower portion of the windshield header member.

17. The air scoop device of claim 12, wherein in the installed state a portion of the windshield equal to a distance between the first sidewall and the second sidewall is enclosed within the hollow interior space bounded by the cutouts of the first sidewall and the second sidewall.

18. The air scoop device of claim 12, wherein the air scoop device is made of a thermoformed plastic selected from the group consisting of polyelefines, polyesters, polybutylene terephthalate, acrylonitrile butadiene styrene and combinations comprising at least one of the foregoing.

* * * * *